US006601616B1

(12) United States Patent
Lenox

(10) Patent No.: US 6,601,616 B1
(45) Date of Patent: Aug. 5, 2003

(54) POWERED CLAMP APPLICATION TOOL

(75) Inventor: Walter W. Lenox, Lakewood, CO (US)

(73) Assignee: Challenger Manufacturing Consultants, Inc., Golden, CO (US)

( * ) Notice: Subject to any disclaimer, the term of this patent is extended or adjusted under 35 U.S.C. 154(b) by 55 days.

(21) Appl. No.: 09/982,420

(22) Filed: Oct. 17, 2001

(51) Int. Cl.[7] ..... B21F 9/02
(52) U.S. Cl. ..... 140/123.6; 140/93.4
(58) Field of Search ..... 140/93 R, 93 A, 140/93.2, 93.4, 123.6, 152; 100/32

(56) References Cited

U.S. PATENT DOCUMENTS

| | | | | |
|---|---|---|---|---|
| 1,653,326 A | | 12/1927 | Welter | |
| 1,789,900 A | * | 1/1931 | Harvey | 100/32 |
| 2,489,535 A | | 11/1949 | Montague | |
| 2,577,861 A | | 12/1951 | Selfridge | |
| 2,921,489 A | | 1/1960 | Schweitzer | |
| 2,923,190 A | | 2/1960 | Ingwer et al. | |
| 2,967,550 A | * | 1/1961 | Rosenberger et al. | 140/93 R |
| 2,998,629 A | | 9/1961 | Smith | |
| 3,013,455 A | | 12/1961 | Bettys | |
| 3,480,270 A | | 11/1969 | Gill | |
| 3,654,033 A | | 4/1972 | Angarola et al. | |
| 3,805,646 A | | 4/1974 | Knight | |
| 3,880,024 A | | 4/1975 | Asada | |
| 3,901,497 A | | 8/1975 | Dearman | |
| 4,313,779 A | | 2/1982 | Nix | |
| 4,460,028 A | | 7/1984 | Henry | |
| D288,167 S | | 2/1987 | Urspruch | D8/61 |
| 4,718,314 A | | 1/1988 | Coyle, Sr. et al. | |
| 5,012,842 A | | 5/1991 | Savard | |
| 5,169,480 A | | 12/1992 | Toppel et al. | |
| 5,205,328 A | * | 4/1993 | Johnson et al. | 140/93 A |
| 5,380,393 A | | 1/1995 | Drabarek et al. | |
| 5,401,011 A | | 3/1995 | Gatenby et al. | |
| 5,853,524 A | | 12/1998 | Nix | |
| 5,918,866 A | | 7/1999 | Klimach | |
| 5,954,899 A | | 9/1999 | Figiel et al. | |

OTHER PUBLICATIONS

Band–It Ultra–Lok Band Clamping System, IDEX Corporation Product Catalog, B–80 7/00, p. 13.

* cited by examiner

*Primary Examiner*—Lowell A. Larson
(74) *Attorney, Agent, or Firm*—Rick Martin; Patent Law Offices of Rick Martin, P.C.

(57) ABSTRACT

A portable electrically powered clamp application tool has a bench mounting kit with a foot pedal control for bench work. The tool has two grippers which enable a powered clamp cutting operation, wherein the only manual step is bending the tightened clamp prior to triggering the cutter arm. A gripper element is non-rotational and has teeth. It locates the material being gripped in a repeatable manner in spite of oil or other lubricants on the clamp.

27 Claims, 13 Drawing Sheets

POWERED CLAMP APPLICATION TOOL

FIELD OF INVENTION

The present invention relates to a band application and cutting machine that pulls one end of a band loop around a workpiece via a powered jaw and then cuts the band via a powered cutter.

BACKGROUND OF THE INVENTION

The industrial applications for winding a metal band or hose clamp around a workpiece such as a hose to secure the hose to a pipe or fitting are well known in the art. One mechanical system is disclosed in U.S. Pat. No. 5,918,866 (1999) to Klimach. A metal band is wound around a workpiece, and then the two ends of the band are fed into two receiving ports on a manually operated strap clamping tool. The clamp is tightened under the effect of a double pulley.

The closest known prior art is made by Band-It-Idex, Inc., a Unit of IDEX Corp., Denver, CO, model Ultra-Lok®, see FIGS. 1 and 2 herein. Models include an AC or a battery powered unit. The unit only handles a one size ¾" specialty clamp made by Band-It™. The clamps can be preformed with the special buckle integral, or free-end with the special buckle separate from the band. Either hose or pole applications can be handled.

Referring to FIGS. 1, 2 an AC unit 1 has a housing 2 which includes a commercial drill motor with integral gear box. The gear box powers a pulling assembly 3. The pulling assembly 3 has a pulling element 4. The gear box powers a screw 6 which pulls the pulling element 4 rearward during the clamp tightening cycle.

In operation a tail of the band to be applied is inserted into the band entry port 7 and gripped by the gripper 5 inside the pulling element 4. Next the gear box is powered to pull the pulling element 4 rearward via the screw 6. Next the cutoff arm 8 is manually pulled forward to form a locking dimple on the tail and then to cut the tail.

FIG. 2 shows a battery powered unit 20 which functions identically to unit 1.

Problems with the Band-It™ units include the limitation of use with Band-It's expensive custom clamps, only available in a ¾" width.

Another problem with the Band-It™ units is the requirement to manually pull the cutoff arm 8 while the operator still needs to control the unit as well as the workpiece. This operation leads to two hands controlling three objects.

Another problem with the Band-It™ units is the inability to bench mount the units for production runs.

These problems are solved by the present invention which provides a bench mount, and can be made portable by detaching the tool from the bench mount, AC or DC system. Either system can handle generic buckles, or pre-formed clamp (band and buckle) or smooth I.D. clamp (eliminates leak path) or center punch clamp or open end clamps. The tool will handle the full range of clamp widths from ¼" to ¾". All of the present invention systems have a powered cutoff assembly.

SUMMARY OF THE INVENTION

The main aspect of the present invention is to provide a power tool which can apply a clamp and cut the clamp end in a powered operation. The application process involves a tightening step.

Another aspect of the present invention is to provide the power tool with the flexibility to handle a wide range of band widths, wherein the bands are of a generic off-the-shelf design.

Another aspect of the present invention is to provide a portable DC power tool that has a bench mount capability for production runs.

Another aspect of the present invention is to provide the power tool with the flexibility to handle both pre-wound and free end clamps.

Another aspect of the present invention is to provide the power tool with a pair of band grippers, one member to pull the band for a tightening operation, and the other member to automatically hold the tightened band in preparation for the cutting operation.

Another aspect of the present invention is to provide a portable clamp application tool which applies prewound steel clamps and by adding an attachment will apply free end clamps as well.

The tool consists of 12V DC electric motor and clutch-gearbox coupled to a reduction gear get, which actuates a threaded nut incorporated into the reduction gear, which rotates around a threaded rod. The rod is attached to a gripping mechanism which pulls the tail of the clamp through a uniquely designed holding pressure mechanism which automatically provides the precise holding pressure required when the clamp is rolled 90° and the excess tail cutoff. Furthermore the act of resetting the pulling gripper automatically cuts the excess from the clamp and requires no hand actuation of a cutoff mechanism.

This tool can be operated portably with a small battery power supply. This allows the operator to go into the field and apply hose clamps without having compressed air or AC electricity available. The tool is of light enough weight to allow bringing the tool to the job as opposed to the present system which demands that the job be brought to the tool. This tool can also be operated as a bench tool with foot operated control, either by drawing its power requirements from a battery or a power supply, which operates from 110V AC. This versatility allows the tool to be operated portably by hand, or mounted to the rear of a service truck, or as a bench-mounted tool in the shop. This is the first application tool, which is portable, battery powered and features adjustable tension control, which will apply the full range of clamps from ¼" to ¾" as well as apply free end clamps.

Incorporated into the device is a pair of spring loaded serrated gripping elements which are essentially free in one direction and which when the product, which is being fed under them in one direction is reversed, one element firmly and repeatably moves a controlled distance before gripping the fed product positively. The distance, which the product moves before being positively gripped, is controlled by the angle of the inclined plane against which the gripping element moves.

This device is very useful for preformed clamp application tools in as much as much as it replaces the complex valving, gaging and plumbing which is presently being used in application tools to accomplish the necessary holding pressure when applying preformed hose clamps.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
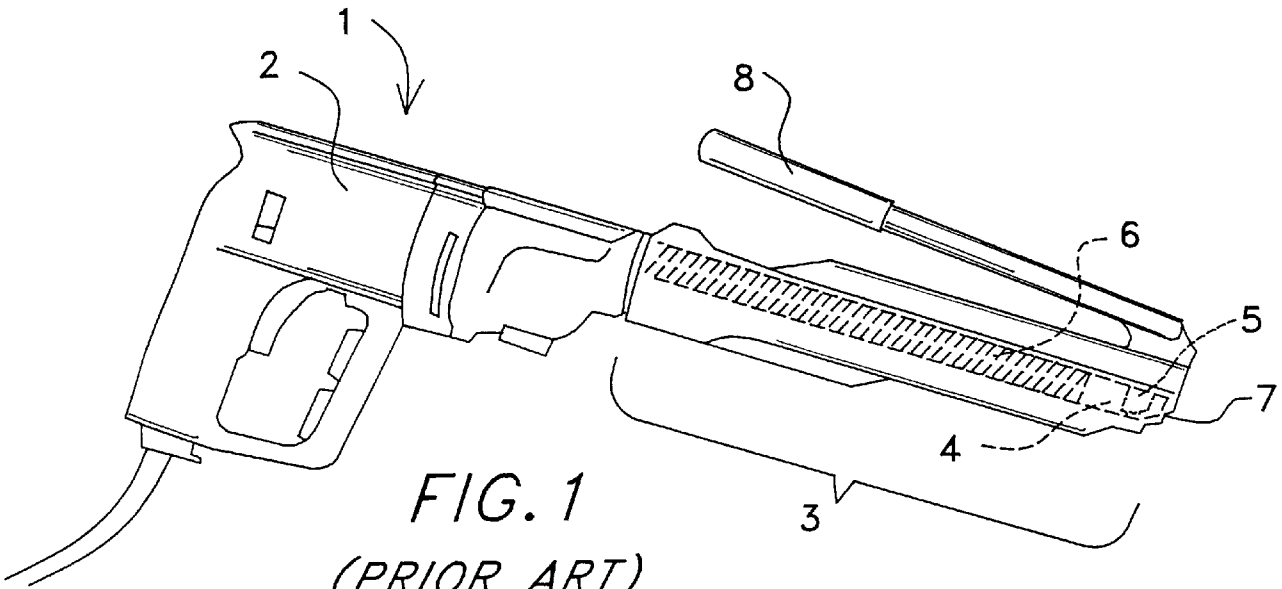
FIG. 1 (PRIOR ART)
FIG. 1 (prior art) is a side perspective view of an AC powered Ultra-Lok® Band Clamping System.
Figure 2:
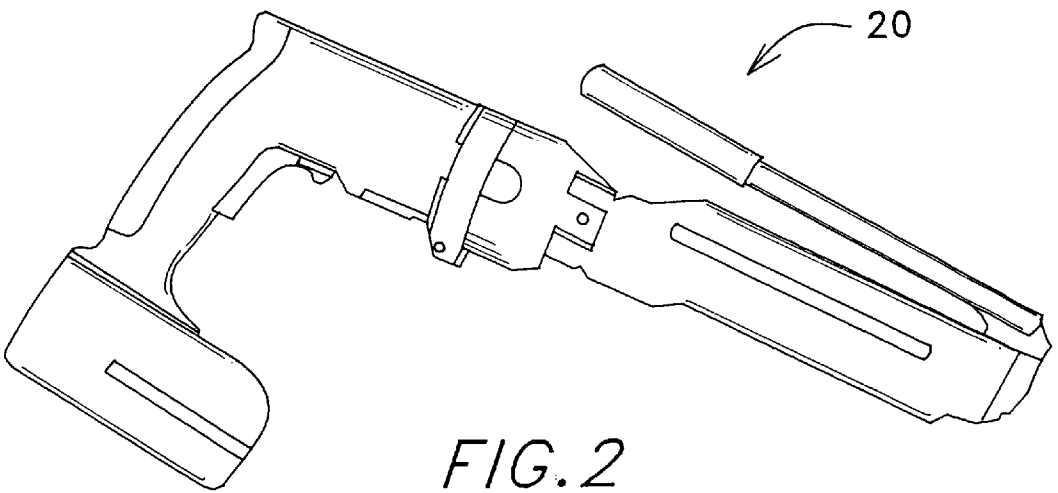
FIG. 2 (PRIOR ART)
FIG. 2 (prior art) is a side perspective view of a battery powered Ultra-Lok® Band Clamping System.
Figure 3:
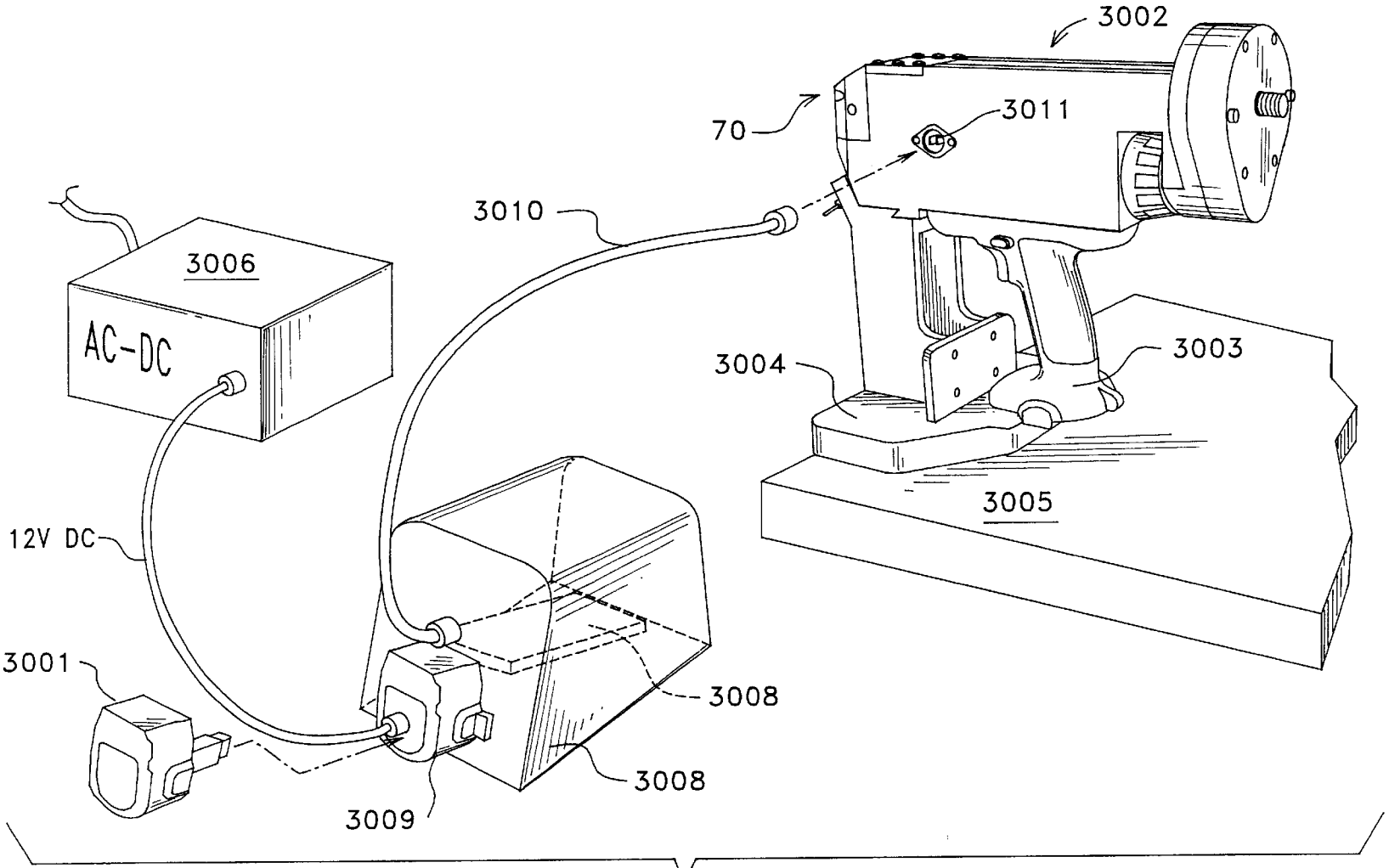
FIG. 3 is a side perspective view of the preferred embodiment clamp applicator system.

Referring next to FIG. 3 a universal clamp application system 3000 is shown. For portable use a battery pack 3001, is plugged into the application module 3002 at handle 3003. The application module is detached from the bench mount 3004 and fully operational.

The bench mount 3004 is attached to a working surface 3005. For bench mounted operation power to the application module can either come from the battery pack 3001 or the AC/DC power supply 3006 which is plugged into wall power. The AC/DC power supply 3006 feeds DC power via cord 3007 to the foot control module 3008.

For AC use the foot pedal 3012 activates DC power to card 3010 which is plugged into socket 3011. The adapter 3009 receives the cord 3007.

For bench mount DC operation the adapter 3009 is replaced with a battery pack 3001.

For applying a generic clamp assembly, the tail of the band is inserted into band entry port 70. Internal assemblies in the application module 3002 grip the tail, pull the tail to the correct tension. The operator then bends the clamp 900, and finally the application module is reversed and in a powered mode cuts the tail from the clamp.

Figure 4:
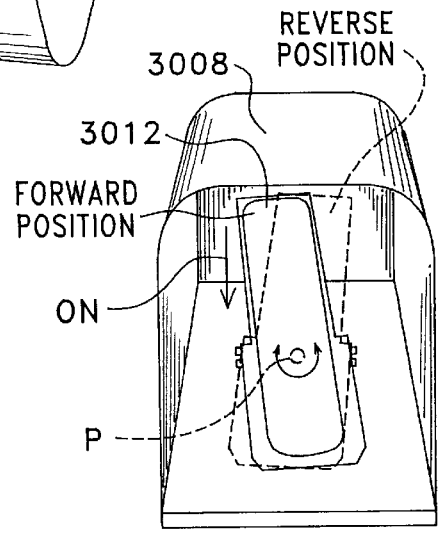
FIG. 4 is a rear perspective view of the foot controller shown in FIG. 3.

Referring next to FIG. 4 the foot pedal module 3008 has the pedal 3012 with a pivot at P so that the dotted position R controls the reverse direction of the application module 3002 which is used in the cutoff operation. The tightening operation is controlled by the left position shown in solid lines. Depressing the pedal 3012 in direction ON powers the application module 3002.

Figure 5:
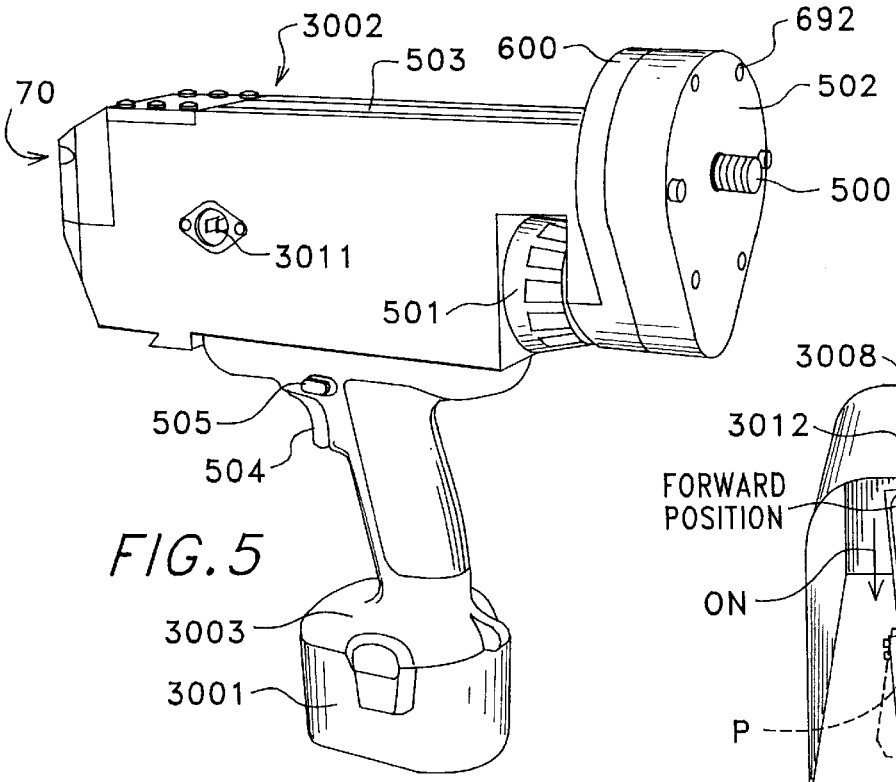
FIG. 5 is a side perspective view of the clamp applicator of FIG. 3 in the portable DC mode.

Referring next to FIG. 5 the application module 3002 is ready to operate in portable DC mode. The battery pack 3001 is plugged into the handle 3003. The trigger 504 controls power to the unit. The switch 505 controls forward, neutral and reverse modes of operation. In the tightening mode the tail of the band is pulled in direction T inside slot 503. In the cutoff mode the switch 505 is set to reverse. When the trigger 504 is activated and the automatic cutoff operation is consummated as noted below.

The gear box 502 powers the screw 500 in a known manner. To allow for variable pulling tension on various width bands, a tension adjustment knob 501 is set for each band width. A known variable clutch assembly varies the transmitted power from the motor to the gear box 502 and ultimately to the non-rotating screw 500.

Figure 6:
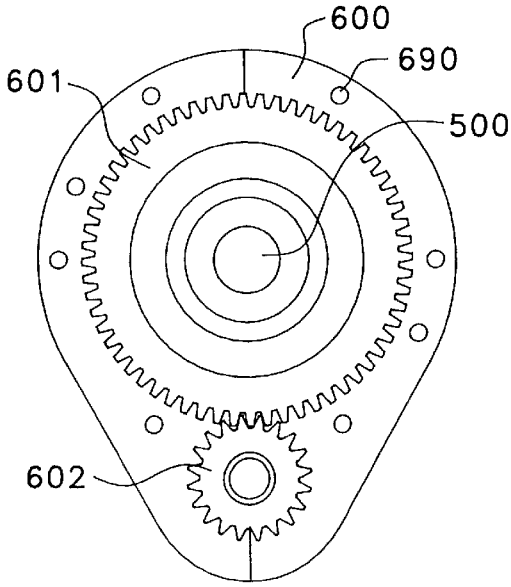
FIG. 6 is a rear plan view of the forward housing (600) of the disassembled gear box housing.

Referring next to FIG. 6 the housing 502 has been removed to disclose the base 600, primary gear 602 and secondary gear 601.

Figure 7:
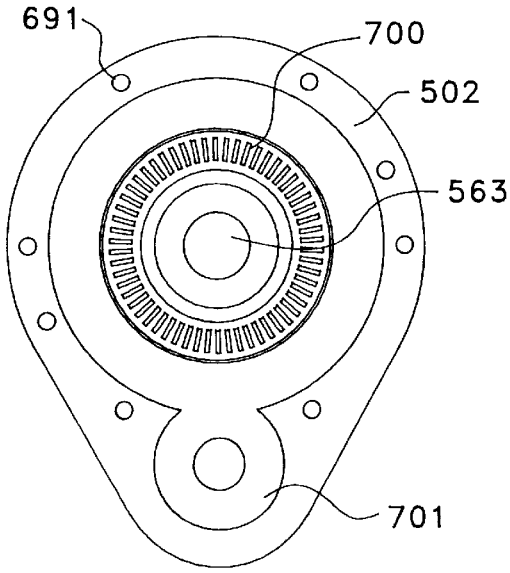
FIG. 7 is a front plan view of the rear housing (502) of the gear box.

Referring next to FIG. 7 the thrust bearing 700 can be seen seated at the rear end of the gear box cover 502, screw hole 563 being shown empty. A primary gear shaft support bearing 701 is seen. A second thrust bearing (not shown) rests against the opposite side of the secondary gear 6*d*.

A bolt 692 passes through holes 691 and then 690, and similar bolts secure members 502 and 600 together as shown.

Figure 8:
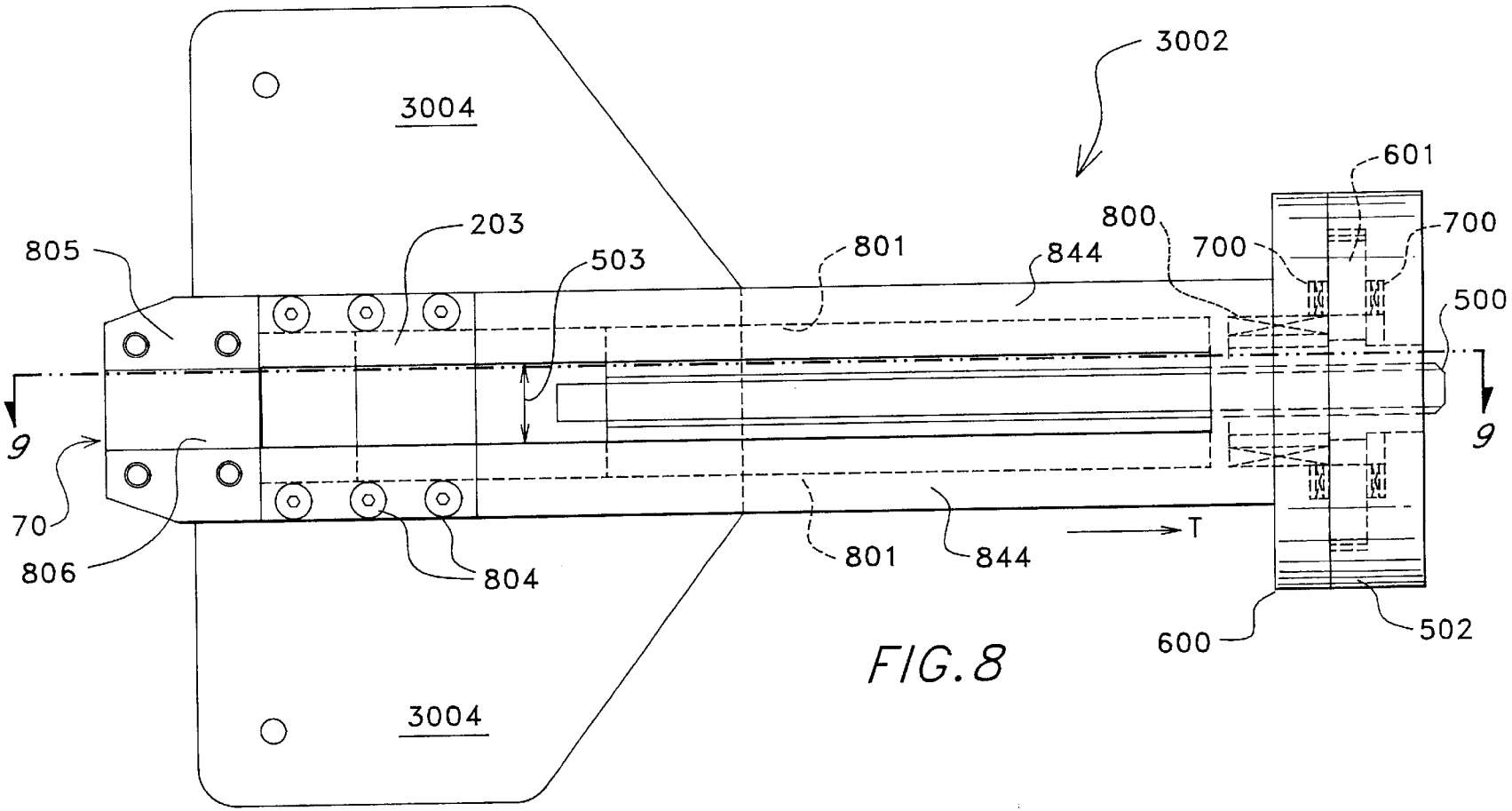
FIG. 8 is a top plan view of the clamp applicator shown in FIG. 3.
Figure 14:
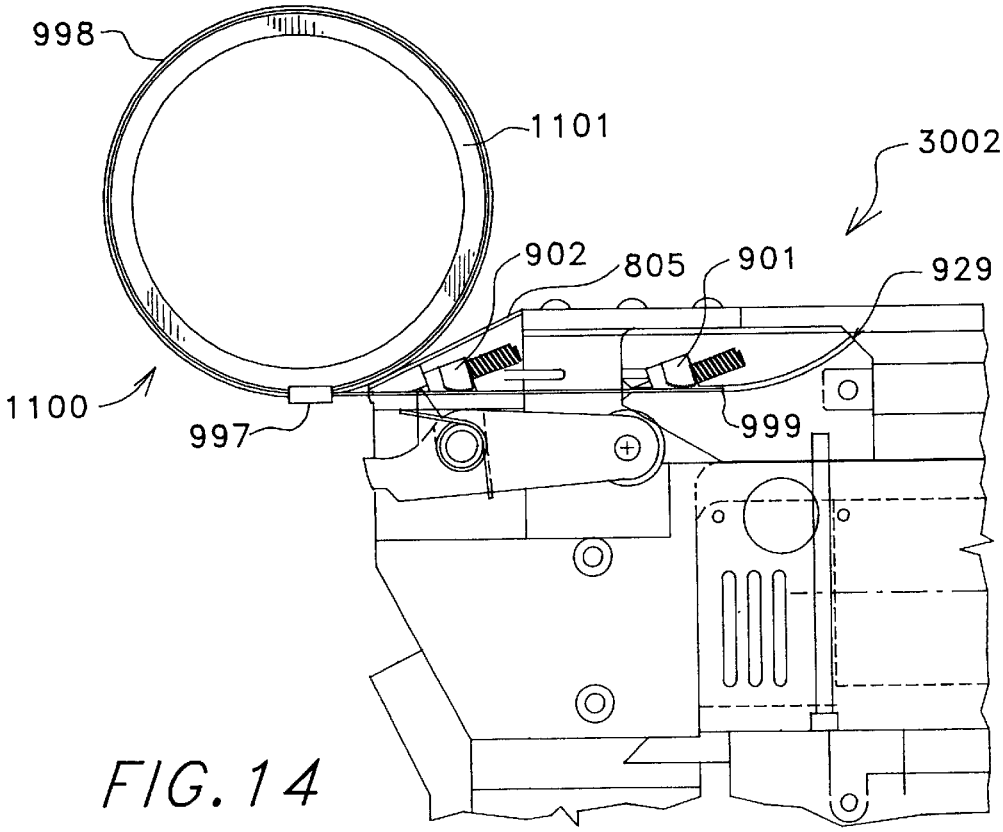
FIG. 14 is the same view as FIG. 13 with the clamp fully inserted into the two grippers and ready for the application procedure.

Referring next to FIG. 8 the slot 503 is clearly shown on top of the clamp applicator 3002. The rest of the top of the top front of the tool consists of a shear plate 805 which has a clearance channel 806. This clearance channel 806 may be about the depth of a typical band to allow the band and workpiece to allow the band and workpiece to be drawn up against the shear plate 805 as shown in FIG. 14. The reaction plate 803 and bolts 804 structurally support the moving gripper.

The main housing 844 may be made of aluminum or other preferably lightweight material. A channel 801 accommodates the non-rotatable screw 500. Bearings 800 are supporting the nut gear shift assembly.

Figure 9:
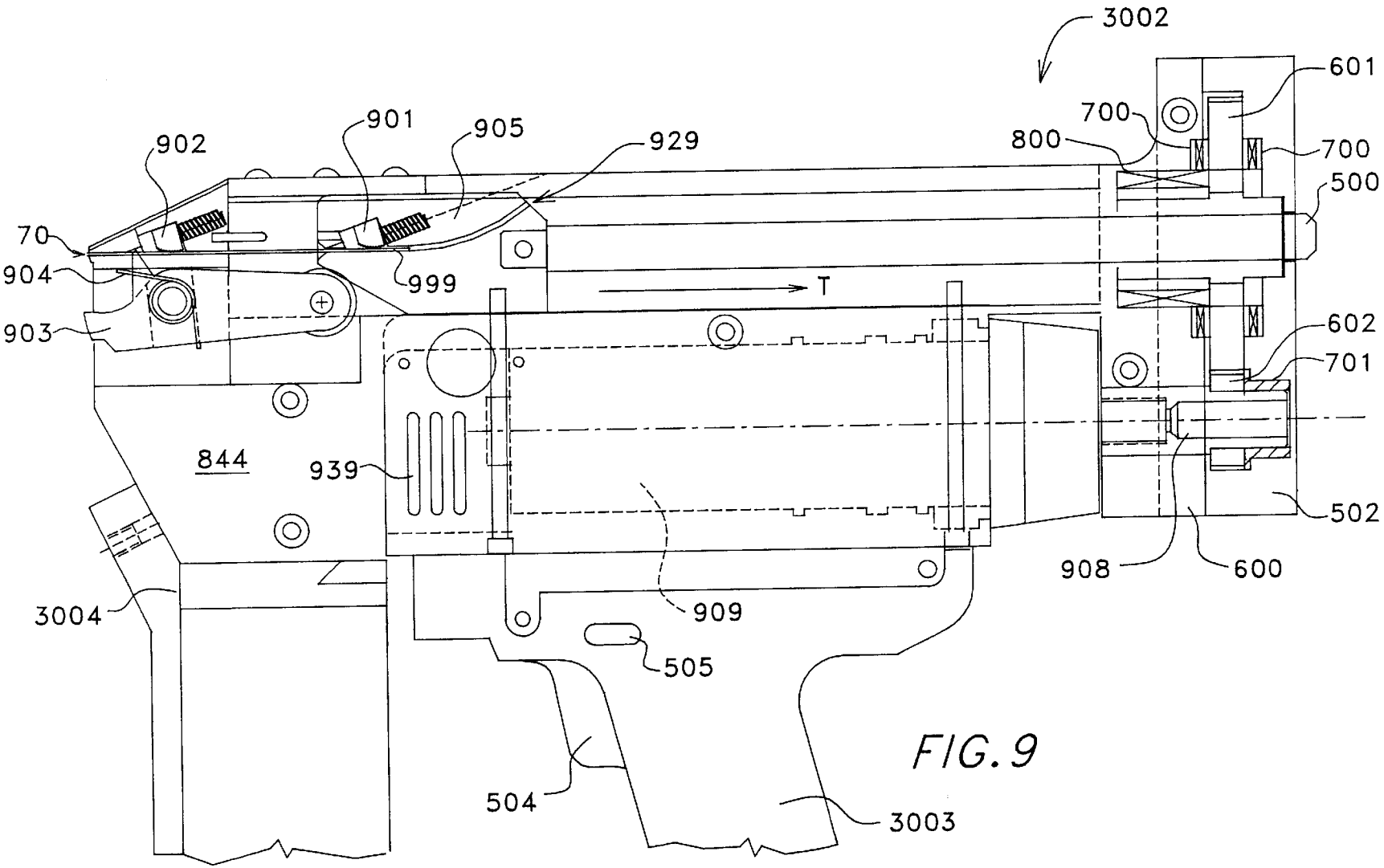
FIG. 9 is a longitudinal sectional view of the clamp applicator taken along line 9—9 of FIG. 8.
Figure 10:
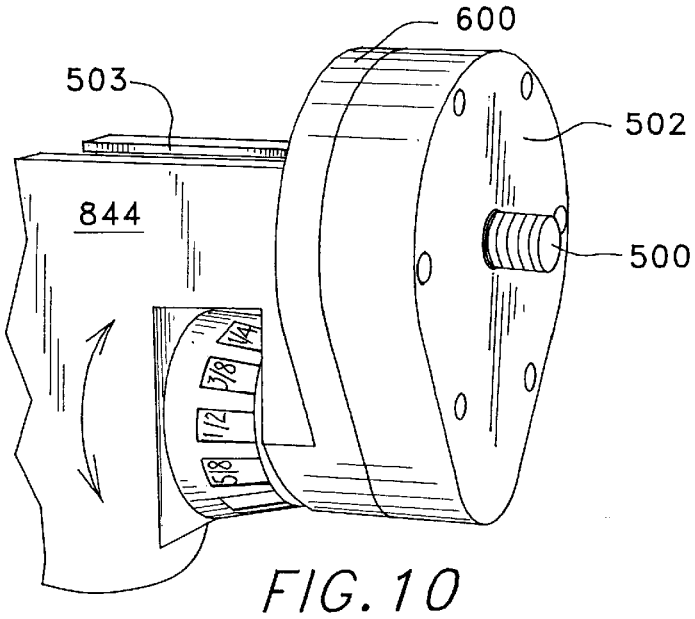
FIG. 10 is a rear perspective view of the clamp applicator showing the tension setting knob.

Referring next to FIG. 9 the air vents 939 in the housing 844 allow the motor and primary gear box assembly 909 to cool. The primary gear shaft 908 turns the primary gear 602. The tail 999 of clamp is shown manually inserted into the entry port 70 and past both the stationary gripper 902 and the movable gripper 901. When the trigger 504 is activated, the movable gripper 901 moves rearward in direction tighten "T" by means of the non-rotating screw 500. For the cutting operation the switch 505 is set to reverse, and the movable gripper is moved back where it started, and the movable gripper 901 releases its grip on the tail 999 in the reverse direction. But in the reverse direction the stationary gripper 902 engages the tail 999 to prevent an unwinding of the tightened clamp. FIG. 9 shows the cutter 903 in the neutral position, held there by the return spring 904. The movable gripper 901 consists of a housing 905 which contains a band exit port 929. When the movable gripper 901 returns to the forward position, the loose tail 999 slides out the band exit port 929.

FIGS. 10–17 show the entire operational sequence for the application of a preformed clamp 1100 around a workpiece 1101. Preformed clamp consists of a tail 999 which is part of a continuous band 998, wherein a buckle anchors both ends of the continuous band 998 when the application is complete.

First the operator adjusts the torque adjustment knob 501 to the width of the band 998. If the torque on the movable gripper 901 is too strong, then the band 998 would yield and finally snap.

Figure 11:
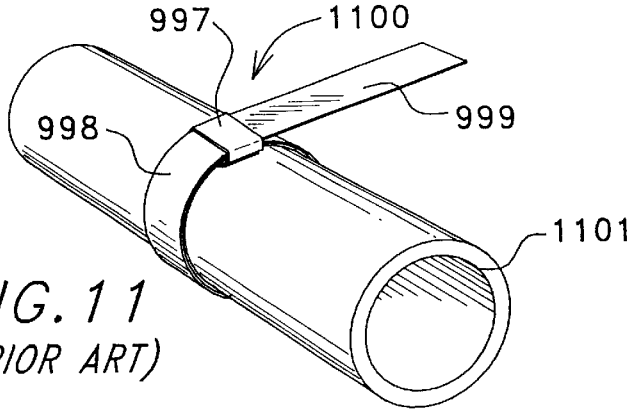
FIG. 11 (PRIOR ART)
FIG. 11 (prior art) is a top perspective view of a preformed clamp on a workpiece.
Figure 12:
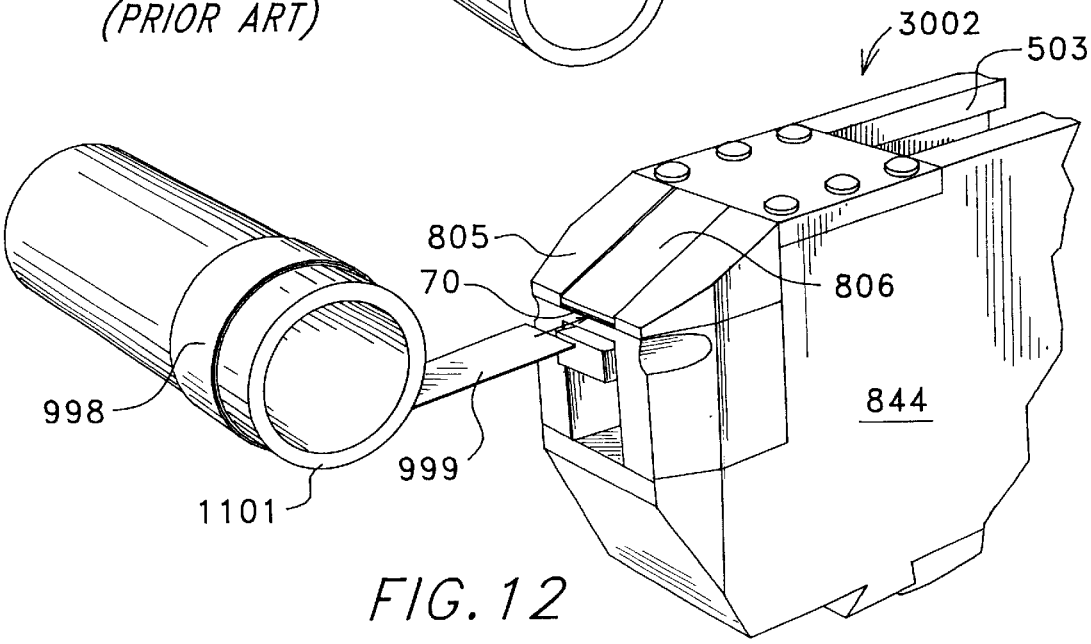
FIG. 12 is a front perspective view of the clamp of FIG. 11 being fed into the entry port of the clamp applicator of FIG. 3.
Figure 13:
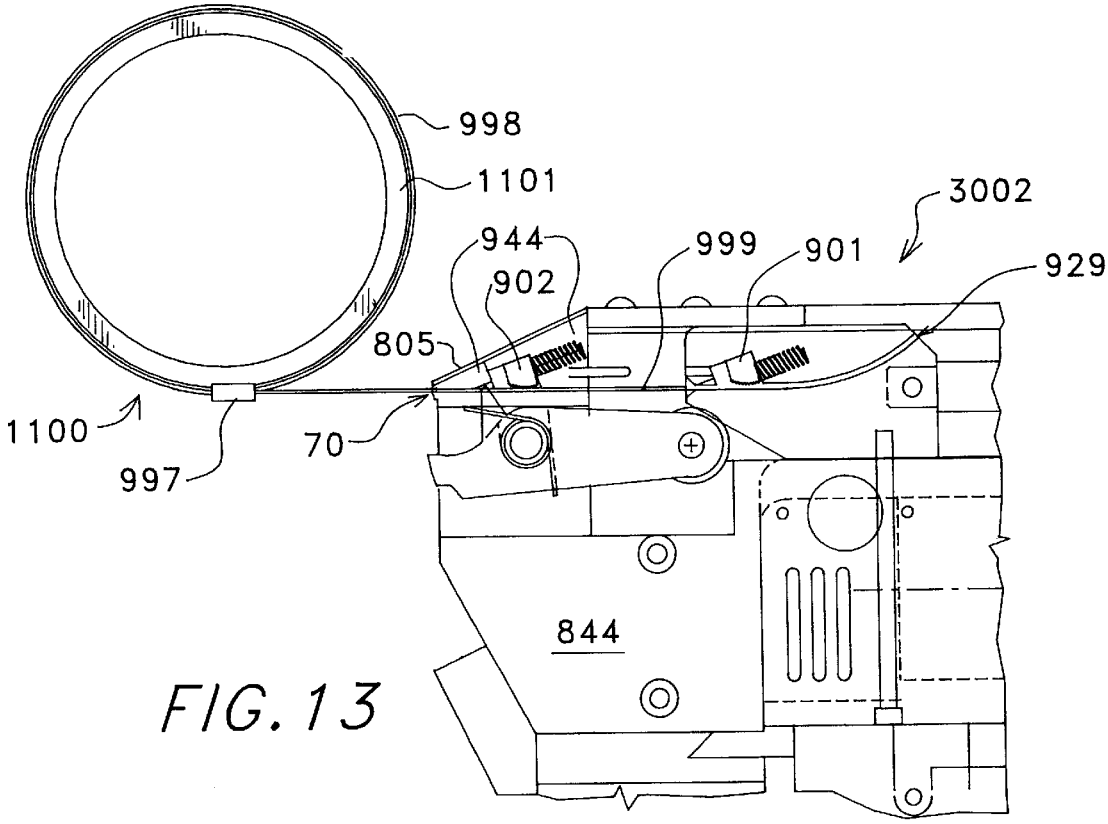
FIG. 13 is a right side partial cutaway view of the clamp being inserted into the entry port of the clamp applicator of FIG. 3.

Next the tail 999 of FIG. 11 is inserted into the port 70 of the clamp applicator 3002 as shown in FIGS. 12, 13, 14 until the buckle 997 rests against the clearance channel 806 of shearplate 805. The tail 999 must pass through both grippers 901, 902 as shown in FIG. 14.

Figure 15:
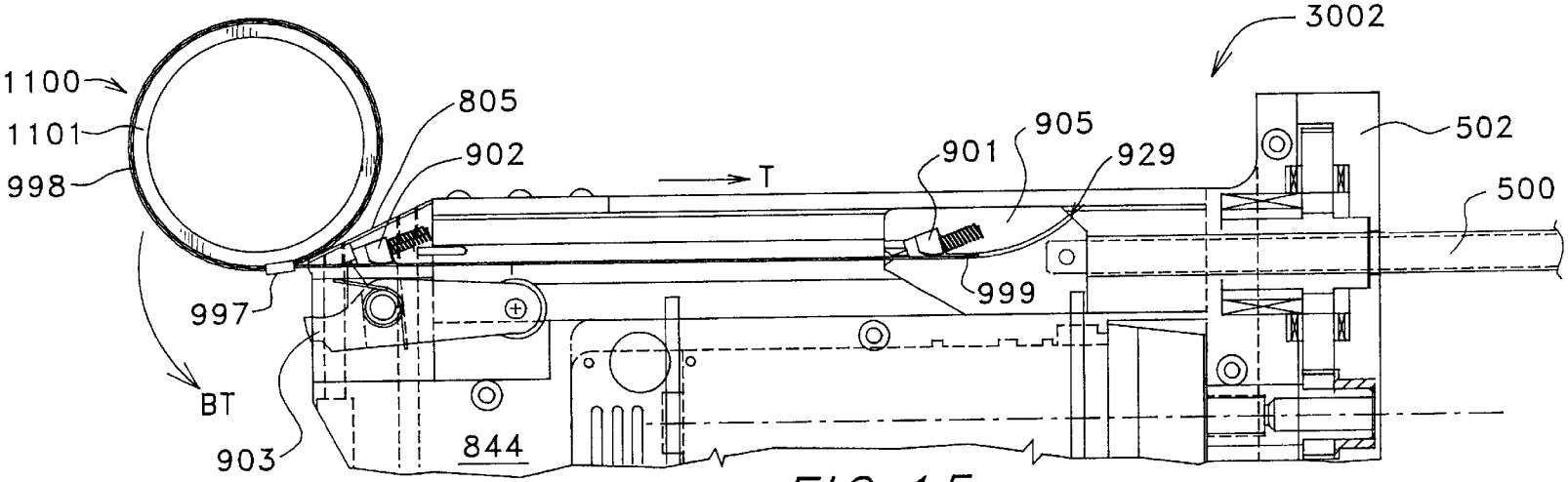
FIG. 15 is the same view as FIGS. 13, 14 with the pulling gripper fully extended rearward.
Figure 16:
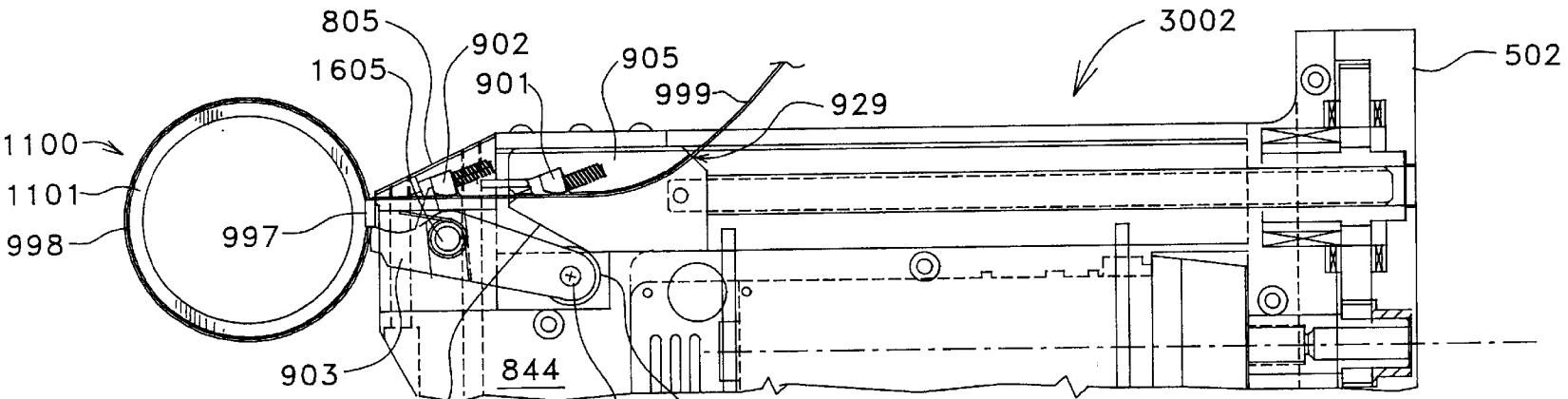
FIG. 16 is the same view as FIGS. 13, 14, 15 with the pulling gripper reversed back to its forward position, the holding gripper has maintained the tension on the taught band, the operator has manually pushed the clamp downward, and the cutting jaw has rotated clockwise to complete the powered cutting procedure.

FIG. 15 shows the movable gripper 901 powered in direction T, which has tightened the clamp 1100. In FIG. 16, the clamp 1100 has been manually rotated counterclockwise in direction BT, thereby locking the band 998 into the buckle 997.

Next in FIG. 16 the operator has reversed the direction of movement of movable gripper 901 so as to return the movable gripper 901 to its starting position. The tail 999 has exited the band exit port 929.

The cutter 903 has been pivoted around pivot 1605 by means of the inclined plane forward edge 1602 of the movable gripper housing 905, which has pushed the roller 1601 of the cutter 903 downward. The roller 1601 has an axle 1600.

Figure 17:
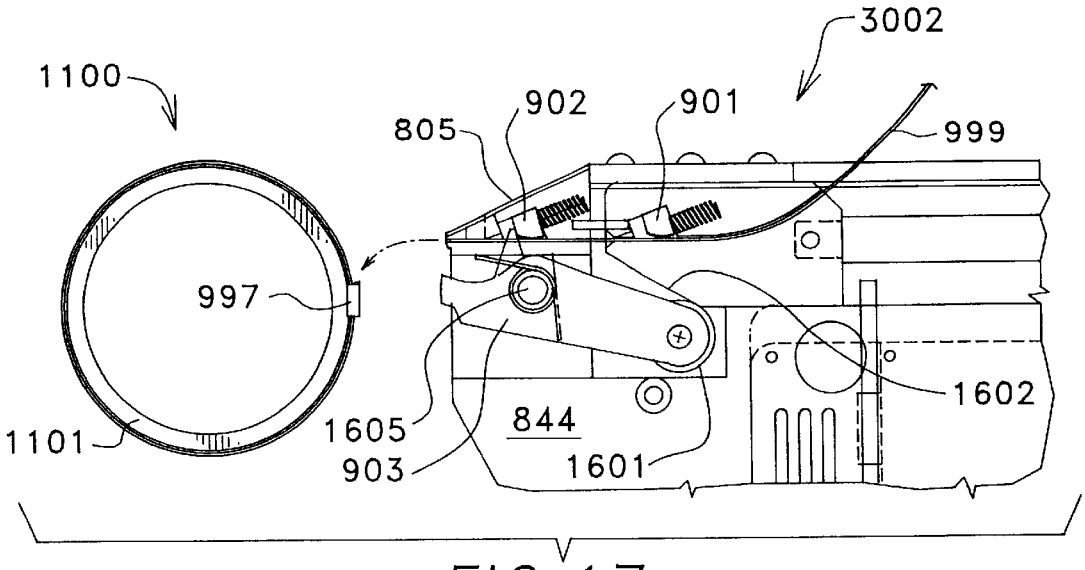
FIG. 17 is the same view as FIGS. 13, 14, 15, 16 showing the cutting procedure completed.
Figure 18:
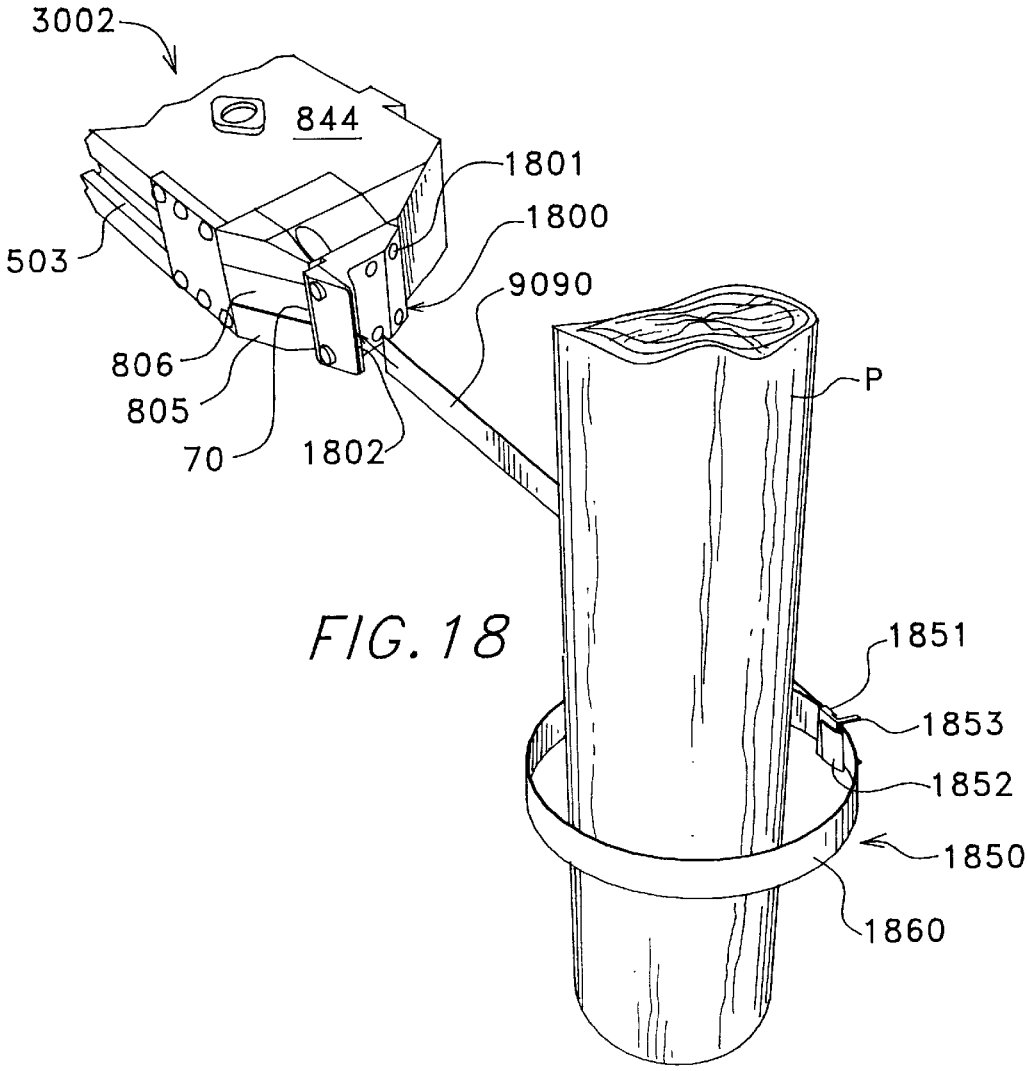
FIG. 18 is a top perspective view of the first step of a free end clamp procedure, where the free end clamp has been manually wound around a post, anchored at one end to a buckle, with the free end of the band about to be fed into the entry port of the free end adapter on the clamp applicator.

FIG. 17 shows the completion of the cutting cycle where the cutter 903 has engaged the buckle moving it and the captured tail 999 upward thereby shearing the tail 999 against the shear portion of the stationary gripper 902 housing 805, and the workpiece 1101 falls free from the clamp applicator 3002.

Referring next to FIGS. 18–23 the application sequence for a free end clamp 1850 applied around a pole P is shown. The clamp applicator 3002 is the same but for the addition of the free and clamp adapter 1800, preferably with four bolts 1801. An extension entry port 1802 extends the entry port for tail 9090 about one inch out from entry port 70.

The prior art free end clamp 1850 consists of a band 1860 where a first end is anchored via a hand bent tab 1852 to the buckle 1851. The tail 9090 slides through the buckle 1851 and then is manually fed into the extension entry port 1802. At the completion of the cutting operation which uses the shear element 1844 to brace the clamp, the lock tabs 1853 are hammered down onto the tail 9090.

Figure 19:
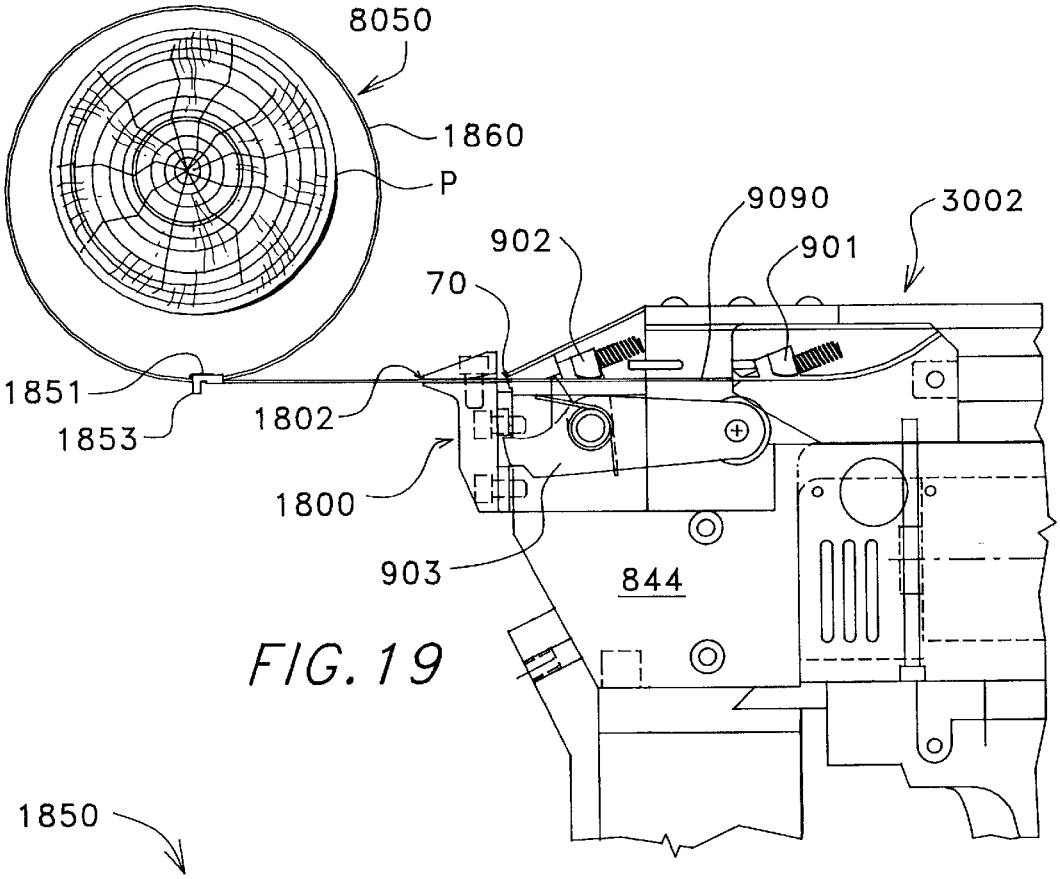
FIG. 19 is a top partial cutaway view of the next step after the FIG. 18 step, where the free end of the band is partially fed into the clamp applicator.
Figure 20:
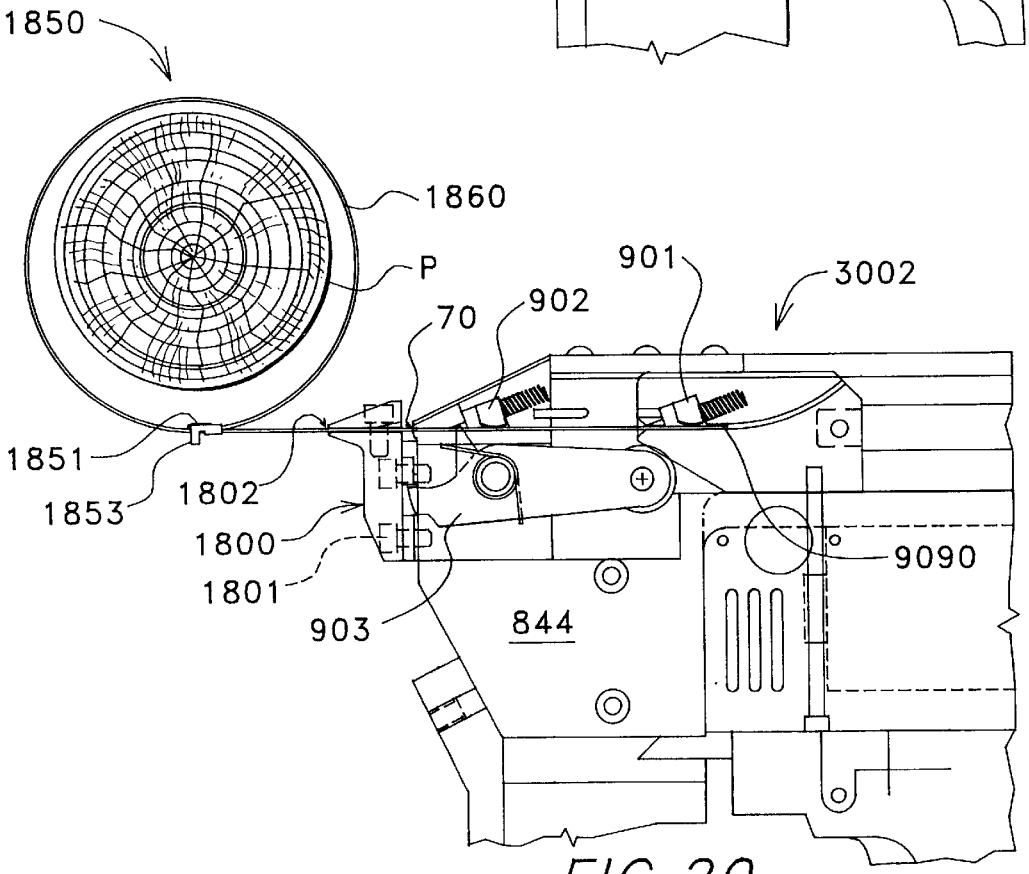
FIG. 20 is the same view as FIG. 19 showing the free end of the band fully inserted past the two grippers.

In FIGS. 19, 20 the tail 9090 is being manually inserted past both the grippers 901, 902.

Figure 21:
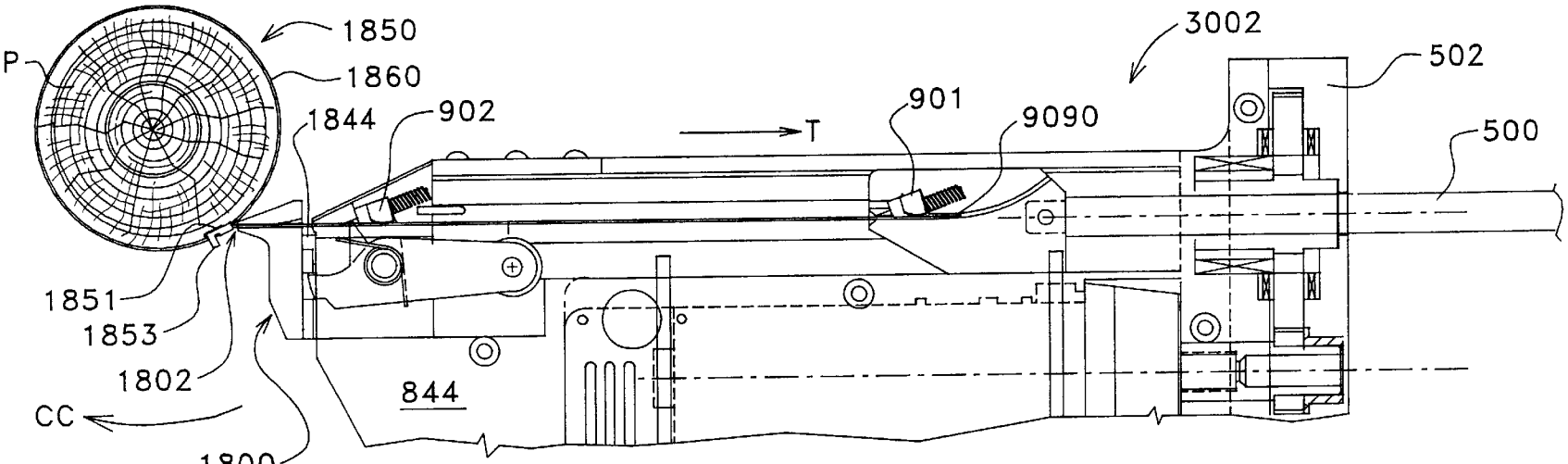
FIG. 21 is the same view as FIGS. 19, 20 showing the pulling gripper fully extended rearward.

FIG. 21 shows the movable gripper 901 powered in direction T to tighten the free end clamp 1850 which has been pulled snug against the extension opening 1802.

Next the operator rotates the clamp applicator 3002 clockwise in order to bend the tail 9090 into a locked mode on the buckle 1851 and prepare for the cutting operation.

Figure 22:
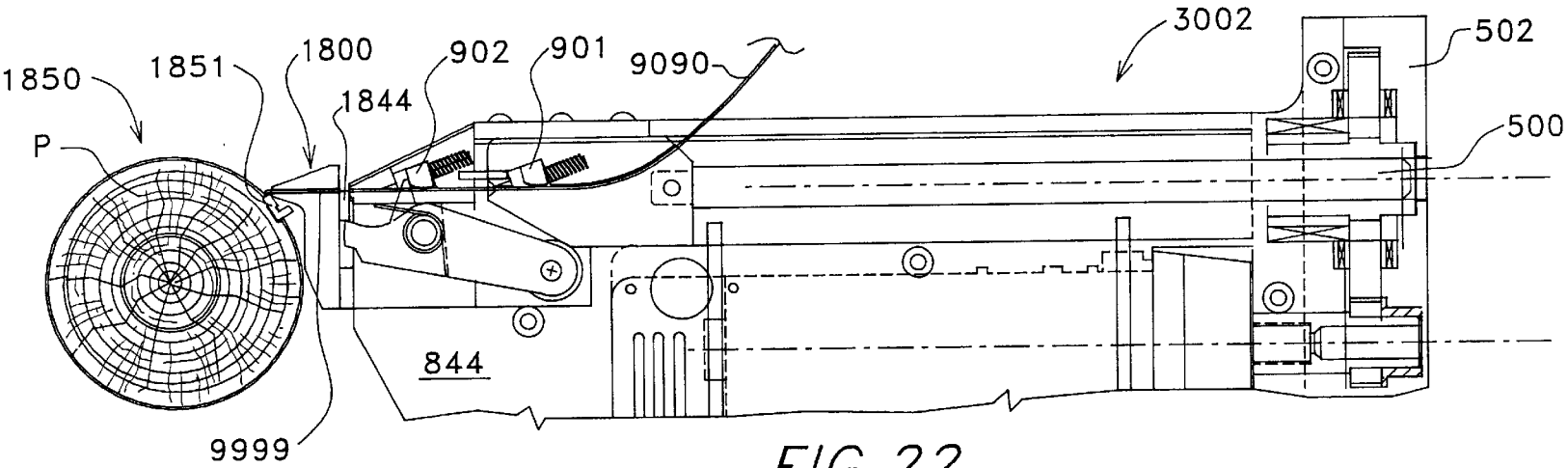
FIG. 22 is the same view as FIGS. 19, 20, 21 showing the pulling gripper reversed and returned back to its start position, and the clamp applicator (rather than the post) has been manually rotated clockwise to bend the free end into the locked position in the buckle in preparation for the cutting procedure which is almost completed.

FIG. 22 shows the same cutting operation with cutter 903 as described in FIG. 16. In this case there is left a one inch lock tail 9999 at the end of tail 9090.

Figure 23:
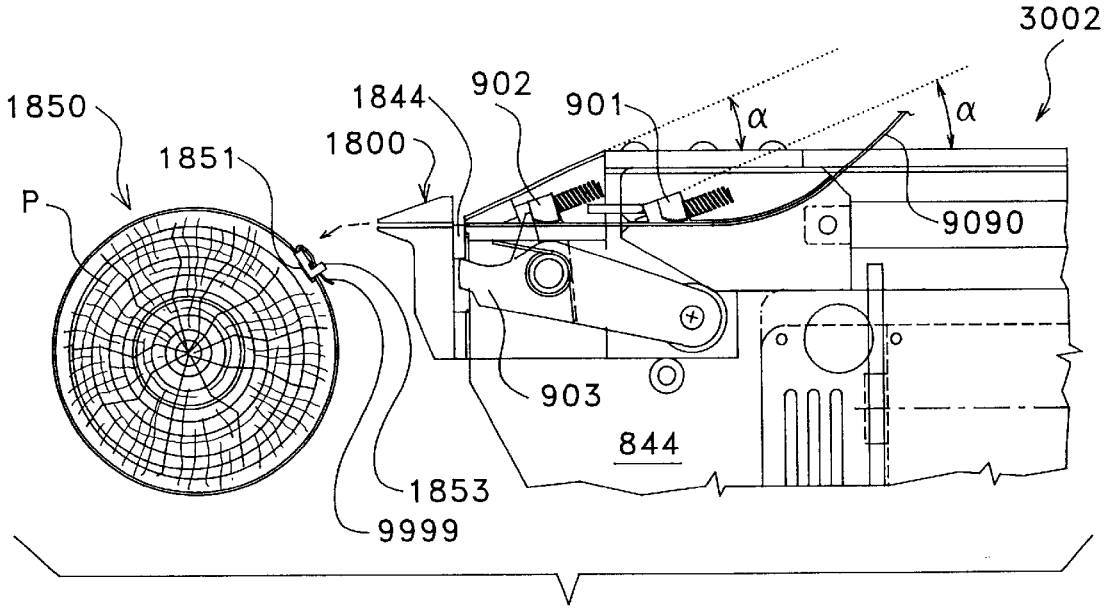
FIG. 23 is the same view as FIGS. 19, 20, 21, 22 with the cutting procedure complete.

FIG. 23 shows the completed cutting operation. The lock tail 9999 has been hammered down onto the buckle 1851. The lock tabs 1853 need to be hammered down to complete the application.

Figure 24:
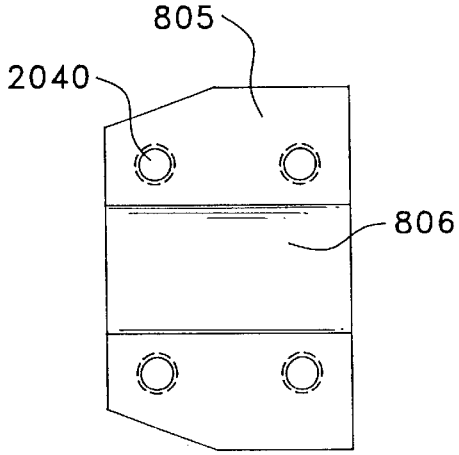
FIG. 24 is a top plan view of the shear plate on top of the tool.
Figure 26:
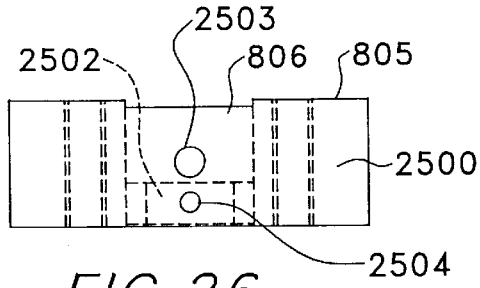
FIG. 26 is a back plan view of the gripper.

Referring next to FIGS. 24–27 the stationary gripper 902 is shown where FIG. 24 shows the top which is the shear plate 805 with gap (clearance channel) G. Bolts 2400 hold the gripper 902 together.

Figure 25:
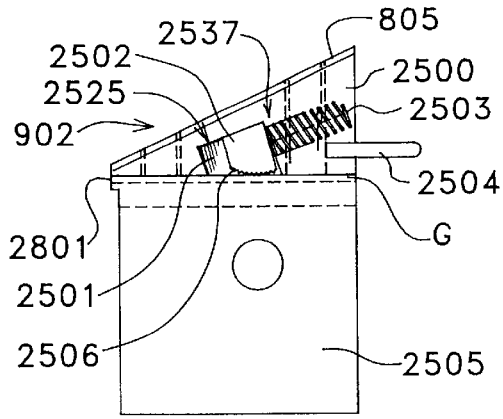
FIG. 25 is a side plan view of the gripper in partial cutaway.

FIG. 25 shows the base 2505 holding the gripper body 2500. The gripper body 2500 has a pocket 2501 in which rides the jaw 2502. The bottom 2506 of the jaw 2502 consists of an arcuate surface having small teeth to grip the bands. The jaw 2502 slides up or down inclined plane 2525 to allow the bottom 2506 to grip and release the bands. The movable gripper release pin 2504 engages the jaw 2502 gripper and releases the excess tail from the movable gripper assembly when the tool is reversed and fully at the end of its travel. A spring 2503 holds the jaw 2502 against the top of the base 2505, and jaw 2502 is displaced rearward and upward to allow the band to slip under it. The band rides in gap G in the top of base 2505.

Figure 27:
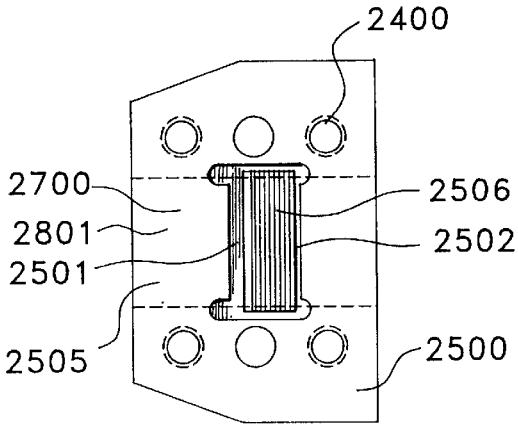
FIG. 27 is a bottom plan view of the gripper.

FIG. 27 shows the limits or width of the track 2700 in which rides the band which is gripped by the bottom 2506 of the jaw 2502. Cutter arm housing 2505 supports the cutter arm 903, and provides the reaction surface for the gripper 902. Shearing edge 2801 shears the clamp in the cutting operation.

Figure 28:
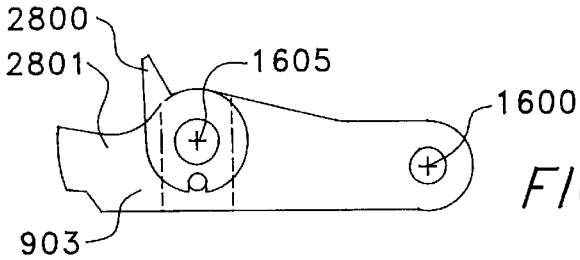
FIG. 28 is a side plan view of the preferred cutter jaw having one near side and one far side attached spurs to open the gripper 902.
Figure 29:
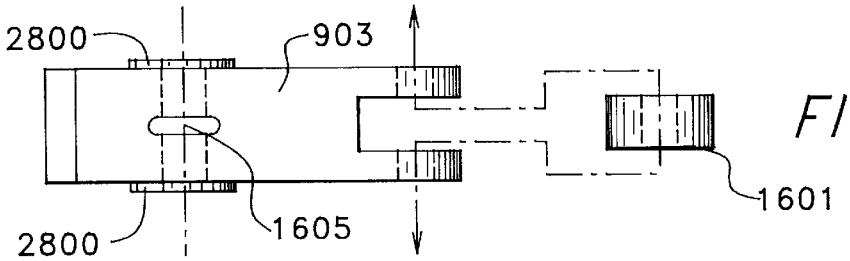
FIG. 29 is a top plan view of the cutter jaw.
Figure 30:
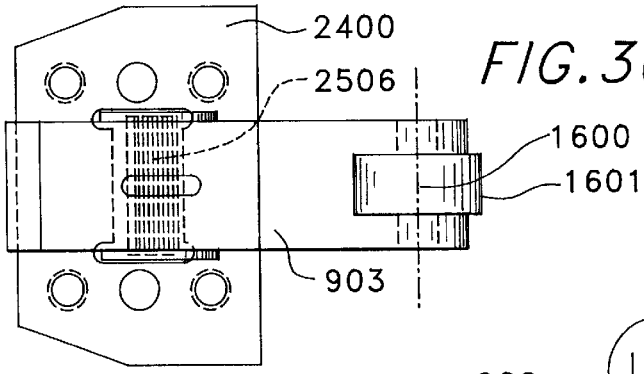
FIG. 30 is a bottom plan view of the cutter jaw with spur able to open the adjacent gripper.

Referring next to FIGS. 28, 29, 30, the spurs 2800 on the cutter 903 push the jaw 2502 loose from the band just after the cutting edge 2801 cuts the band. This allows the tail of the band 9090 to be removed and discarded.

Figure 31:
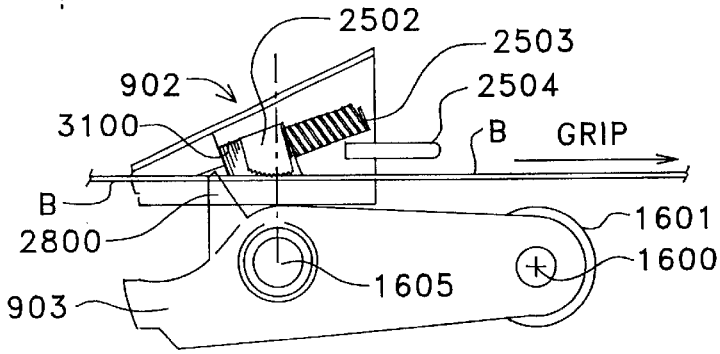
FIG. 31 is a side partial cutaway view of the cutter jaw spur disengaged from the gripper.
Figure 32:
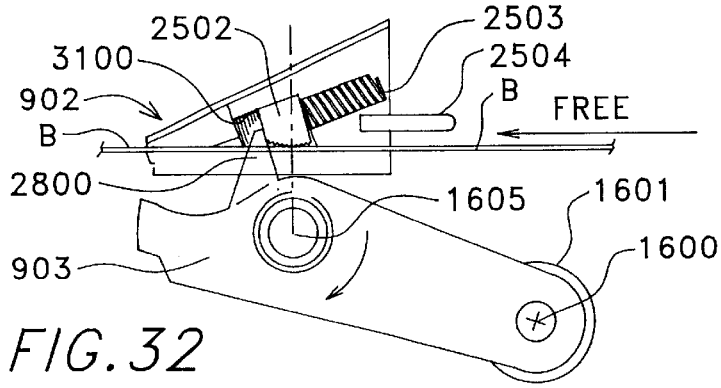
FIG. 32 is the same view as FIG. 31 with the cutter jaw spur engaged with the gripper allowing the band to be withdrawn from the gripper.

Referring next to FIGS. 23, 31, 32 the jaw 2502 slides along an angled surface 3100 of the pocket 2501. The angle L is preferably 20°. The angle L is chosen to allow the band B to move forward a tiny bit (0.010–0.030 inch) when the cutting operation begins and the movable gripper 901 moves forward. This tiny slack releases the considerable tension which exists between the clamp/workpiece and the shear-plate 805. This tiny slack allows the manual bending of the clamp in preparation for the cutting operation, and eliminates complex known holding mechanisms.

FIGS. 31, 32 show how the spur 2800 moves the jaw 2502 back to allow release of the excess band B after the cutting operation.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A clamp applicator comprising:

a housing having a motor with an ON/OFF and a FORWARD/REVERSE switch;

a first gripper located near a band entry port in the housing;

a second gripper having a linkage to the motor to move forward toward the entry port and backward;

a cutter in the housing for cutting a tightened clamp;

wherein a clamp tightening mode of operation powers the second gripper backward while gripping a segment of a clamp, thereby tightening the clamp; and wherein a clamp cutting mode of operation powers the second gripper forward, thereby releasing its grip on the clamp segment and activating the cutter to cut the clamp segment.

2. The apparatus of claim 1, wherein the cutter further comprises a pivot mount in the housing, and the second gripper has a mechanical interface with one end of the cutter to pivot a cutting end of the cutter into contact with the segment of the clamp during the cutting mode of operation.

3. The apparatus of claim 2, wherein the first gripper has a jaw that prevents the clamp segment from moving forward during the cutting mode of operation.

4. The apparatus of claim 3, wherein the first gripper jaw travels in an angled slot so as to allow a proper slack in the clamp segment during the cutting mode of operation.

5. The apparatus of claim 3, wherein the linkage further comprises a gear assembly and a torque adjustment assembly for the second gripper, thereby providing a variable tensioning capability to the clamp applicator for accommodating a plurality of clamp widths.

6. The apparatus of claim 5, wherein the housing further comprises a screw drive for the second gripper.

7. The apparatus of claim 1, wherein the motor is a DC type, the housing has a battery pack, and the housing has a DC input receptacle.

8. The apparatus of claim 7, further comprising a detachable bench mounting base for the housing.

9. The apparatus of claim 8 further comprising and AC/DC converter and a foot pedal controller for the motor, wherein both speed and direction are controlled by the foot.

10. The apparatus of claim 1 further comprising a free end clamp adapter having a free end port on the housing and located forward of the entry port.

11. A clamp applicator comprising:

a housing having a motor;

a powered pulling member having a clamp which removably attaches to a clamp segment; and a powered cutter to cut the clamp segment.

12. The apparatus of claim 11, wherein the pulling member further comprises a screw powered housing which contains an angled slot with a movable jaw therein.

13. The apparatus of claim 12 further comprising a stationary gripper located near a clamp entry port, said stationary gripper having a movable jaw to hold a segment of a tightened clamp.

14. The apparatus of claim 13, wherein the motor further comprises an ON/OFF and FORWARD/REVERSE switch, wherein the FORWARD mode powers the pulling member rearward, thereby pulling and tensioning the clamp, the reverse switch powers the pulling element forward, forcing a cutter into the clamp segment, and resetting the tool for the next clamp.

15. The apparatus of claim 14, wherein the cutter has a pivot and a lever arm, and the pulling member housing forces the lever arm to activate the cutter.

16. The apparatus of claim 15, wherein the pulling member housing has a clamp exit port to allow the clamp segment to leave the housing in the REVERSE-RESET mode.

17. The apparatus of claim 14 further comprising a gear assembly and a variable torque clutch to enable a range of clamp widths to be applied.

18. The apparatus of claim 17 further comprising a free end clamp adapter to removably fasten adjacent to an entry port of the housing.

19. The apparatus of claim 11, wherein the motor is a DC type, and the housing receives a battery pack.

20. The apparatus of claim 11 further comprising a bench mount for the housing, an AC-DC converter, a foot switch controller and a DC input port on the housing.

21. A clamp applicator comprising:

a housing having a motor, a clamp entry port, a pulling member means functioning to pull a clamp segment away from the clamp entry port via a linkage to the motor; and a cutter means function to cut the clamp segment via a linkage to the motor.

22. The apparatus of claim 21, wherein the cutter means further comprises a pivotable arm having a cutting end and a lever end, and the linkage to the motor further comprises a gear assembly moving the pulling member means against the lever end.

23. The apparatus of claim 22 further comprising a stationary gripper means function to hold the clamp segment during a cutting operation.

24. The apparatus of claim 21, wherein the motor is a DC type, and the housing receives a battery pack.

25. The apparatus of claim 24 further comprising a bench mount, and AC/DC converter, a DC port on the housing and a foot activated controller for the motor.

26. The apparatus of claim 21 further comprising a free end clamp adapter removably attachable adjacent to an entry port of the housing.

27. The apparatus of claim 21 further comprising a variable torque transmission means for the motor to transmit an adjustable force to the pulling member means, thereby enabling an application of various width clamps.

* * * * *